US006170681B1

(12) United States Patent
Yoshimatsu

(10) Patent No.: US 6,170,681 B1
(45) Date of Patent: Jan. 9, 2001

(54) SWING TYPE MACHINE AND METHOD FOR SETTING A SAFE WORK AREA AND A RATED LOAD IN SAME

(75) Inventor: Hideaki Yoshimatsu, Akashi (JP)

(73) Assignee: Kabushiki Kaisha Kobe Seiko Sho (Kobe Steel, Ltd.) Steel, Kobe (JP)

( * ) Notice: Under 35 U.S.C. 154(b), the term of this patent shall be extended for 0 days.

(21) Appl. No.: 09/356,349

(22) Filed: Jul. 19, 1999

(30) Foreign Application Priority Data

Jul. 21, 1998 (JP) ..... 10-205553

(51) Int. Cl.[7] ..... B66C 23/90
(52) U.S. Cl. ..... 212/278; 212/280
(58) Field of Search ..... 212/276, 277, 212/278, 280, 270

(56) References Cited

U.S. PATENT DOCUMENTS 5,160,056 11/1992 Yoshimatsu et al. .
5,217,126 6/1993 Hayashi et al. .
5,251,768 10/1993 Yoshimatsu et al. .
5,823,370 * 10/1998 Ueda ..... 212/276

FOREIGN PATENT DOCUMENTS

2189456 * 10/1987 (GB) ..... 212/278
5-116889 5/1993 (JP) .

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A method for setting a safe work area and a rated load in a swing type work machine, as well as a swing type work machine which utilizes the said method, are disclosed. An area where a strength-based safe work area which is established taking the strength of a swing member into account and a stability-based safe work area which is established taking the stability of the work machine into account overlap each other, is set as a safe work area to be used actually. Likewise, out of a strength-based rated load which is set taking the strength of the swing member into consideration and a stability-based rated load which is set taking the stability of the work machine into consideration, the lower one is set as a rated load to be used actually. Using the safe work area and rated load thus obtained, there are made a safety control and an appropriate display. According to this method, in a swing type work machine such as a crane, it is possible to establish a safe work area and a rated load both matching the actual hoisting capacity of the work machine.

20 Claims, 12 Drawing Sheets

SWING TYPE MACHINE AND METHOD FOR SETTING A SAFE WORK AREA AND A RATED LOAD IN SAME

BACKGROUND OF THE INVENTION

1. Field of the Invention

The present invention relates to a swing type work machine such as a crane having a swing member provided with a boom or the like, as well as a method for setting a safe work area and a rated load according to a working state of the machine.

2. Description of the Related Art

Generally, in such a swing type work machine as above it is required, from the standpoint of safety, to prevent breakage and tipping during a swing work of the machine, and as means for satisfying such requirement it is very important to properly set a rated load and a safe work area, or a limit working radius, for operating the machine safely.

In the above rated load and safe work area there are included a strength-based rated load (safe work area) which is set taking the strength of each component into account and a stability-based rated load (safe work area) which is set taking the stability of the work machine into account. In determining the former, i.e., strength-based rated load (safe work area), importance is attached to the strength of a swing member such as a boom which becomes most disadvantageous in strength during a swing work, and a rated (safe work area) is established on the basis of the said strength. On the other hand, the latter, i.e., stability-based rated load (safe work area) is established for the purpose of preventing the tipping of the work machine during a swing work. Therefore, this rated load (safe work area) inevitably varies depending on the direction of the swing member such as a boom.

All of the above rated loads (safe work areas) are extremely important parameters in ensuring the safety of the work machine. According to the prior art, minimum values of the above strength-based rated load (safe work area) and stability-based rated load (safe work area), (more particularly, rated loads or safe work areas in a sideways protruded state of the boom in which the work machine is most likely to tip), are calculated and the smaller rated load (safe work area) is adopted as a safety parameter to be used actually, then a swing control or warning is performed in accordance with the thus-adopted rated load (safe work area).

In FIG. 13, strength-based safe work areas and stability-based safe work areas, which are calculated in an actual crane, are indicated by broken lines 91 and dash-double dot lines 92, respectively. More specifically, in a polar coordinate plane with a work radius and a wing angle as variables, strength-based safe work areas and stability-based safe areas, which correspond to specific hoisting loads, are shown in terms of contour lines.

In the same figure, O denotes a swing center of the swing member in the crane, FL denotes a support point by an outrigger jack protruded at the left front portion of the crane, FR denotes a support point by an outrigger jack protruded at the right front portion of the crane, RL denotes a support point by an outrigger jack protruded at the left rear portion of the crane, and RR denotes a support point by an outrigger jack at the right rear portion of the crane.

As noted above, since the strength-based safe work area is set taking the strength of the swing member of the boom or the like into account, its limit work radius is independent of the swing angle and the larger the hoisting load, the smaller the limit work radius. Therefore, the strength-based safe work areas corresponding to hoisting loads assume the shape of such concentric circles as shown by the broken lines 91 in FIG. 13.

On the other hand, the stability-based safe areas are set for preventing the tipping of the entire crane, so their schematic shapes describe a square contour line diagram surrounded with straight lines nearly parallel to tipping lines. Further, when a deformation of the boom is taken into account, there are described generally square shapes surrounded with curves which are centrally expanded somewhat outwards to an extent corresponding to the boom deflection rather than with straight lines parallel to tipping lines, as indicated by dash-double dot lines 92 in FIG. 13. The "tipping line" indicates a rotational center line at the time of tipping of the crane. For example, a tipping line in the left-hand side direction is a straight line connecting the support points FL and RL.

Thus, the stability-based safe work area originally assumes an irregular shape, so even at the same hoisting load, there ought to be different safe work areas or rated loads between the case where an article is hoisted sideways and the case where it is hoisted obliquely forward or obliquely backward. In a conventional crane or the like, however, a certain limit work radius, i.e., the smaller work radius between a minimum value of a limit work radius which depends on strength and a minimum value of a limit work radius which depends on stability, is established throughout the whole circumference, so the hoisting work particularly at an obliquely front position or an obliquely rear position is limited to a greater extent than necessary and hence the capacity thereof is not fully exhibited. This is also the case with setting rated loads.

In Japanese Patent Laid Open No.5,116889 ( a Japanese Patent Application corresponding to U.S. Pat. No. 5,217,126; hereby fully incorporated by reference) there is disclosed a device in which when outrigger jacks are protruded non-uniformly right and left, a safe work area is deformed into a shape other than a circle according to the protruded states. But this work area deformation takes into account only such non-uniform protrusion of outrigger jacks. Also in the said device, when all the outrigger jacks are protruded uniformly, certain limit work radium and rated load are set throughout the whole circumference. Thus, it cannot be said that the device disclosed in the above publication provides an effective measure for solving the foregoing problem.

SUMMARY OF THE INVENTION

It is an object of the present invention to provide a method capable of setting a safe work area and a rated load both matching an actual hoisting capacity of a swing type work machine such as a crane, as well as a swing type work machine capable of making an appropriate safety control and a useful display with use of the so-set safe work area and rated load.

According to the present invention there is provided a method of setting a safe work area for safely operating a swing type work machine in which an article is suspended at a predetermined position of a swing member. In this method, a safe work area which is set in consideration of the strength of a swing member and which is circular centered on a rotational center of the swing member, is assumed to be a strength-based safe work area, while a safe work area which is set in consideration of the stability of the work machine and whose limit work radius changes depending on the swing angle of the swing member, is assumed to be a stability-based safe work area, and an area where both said safe work areas overlap each other is established as a safe work area to be used actually.

According to the present invention there is provided a swing type work machine for realizing the method of setting the above safe work area, with an article being suspended at a predetermined position of a swing member. The swing type work machine is provided with a hoisting load detecting means for detecting a hoisting load of the swing member and an area data output means which outputs an area data of a safe work area to be used actually, the said safe work area being an area where a strength-based safe work area and a stability-based safe work area overlap each other, the strength-based safe work area being set taking a hoisting load and the strength of the swing member into account and being circular centered on a rotational center of the swing member, the stability-based safe work area being set taking the stability of the work machine into account and whose limit work radius changes depending on a swing angle of the swing member.

In the above method and the above swing type work machine which adopts the said method, there is used a combination of the strength-based safe work area whose limit work radius is constant irrespective of the swing angle and the stability-based safe work area whose limit work radius changes depending on the swing angle, that is, there is used a useful safe work area matching the capacity of a crane which is used actually.

Preferably, the stability-based safe work area is an area surrounded with straight lines parallel to tipping lines in the work machine or lines similar thereto. In the case of a work machine whose tipping directions are substantially limited to front, rear and right, left directions like, say, a wheel crane provided with outrigger jacks, a line as a tipping center of the crane in the case of the crane tipping in any of front, rear and right, left directions corresponds to each "tipping line." In this case, therefore, the stability-based safe work area assumes a rectangular shape or a shape similar thereto. On the other hand, in the case of a work machine whose tipping directions are not limited to front, rear and right, left directions, like a crawler crane, the shape of the line in question is determined according to concrete tipping characteristics of the work machine.

If a final safe work area is established within a circle whose radius corresponds to the maximum work radius of the swing member centered on the rotational center of the swing member, the safe work area will be a practical safe work area which matches the actual situation more closely.

Preferably, the foregoing area data output means has a memory which stores three-dimensional data using as variables the work radius and swing angle of the swing member and the corresponding rated load, and it calculates and outputs a corresponding safe work area from the hoisting load detected by the hoisting load detecting means. According to this construction, the safe work area is outputted rapidly on the basis of the stored data.

In the case where the swing type work machine is provided with outrigger jacks protruded in the horizontal direction, the above area data output means preferably has a memory which stores plural kinds of three-dimensional data according to protruded states of the outrigger jacks. This construction permits a rapid output of a safe work area suitable for the actual protruded state of the outrigger jacks.

Preferably, the swing type work machine is provided with a work radius detecting means for detecting an actual work radius of the swing member, a swing angle detecting means for detecting an actual swing angle of the swing member, and a safety control means which makes control to let the work machine perform safe operations on the basis of a comparison of the safe work area outputted from the area data output means with actual work. radius and swing angle.

In this swing type work machine, an appropriate safety control is conducted on the basis of the safe work area calculated in the above manner.

For example, the safety control means may be a warning control means which issues a warning when the work position has approached a boundary line of the safe work area, or it may be provided with a swing control means which makes control so that a swing brake is applied at a predetermined timing to stop the swing member within the safe work area. In the latter case, the swing member can be automatically prevented from departing from the safe work area.

Preferably, the swing control means is provided with a brake angle acceleration calculating means for stopping the swing member without permitting any residual deflection of a suspended article, and makes control so that the rotation of the swing member is braked on the basis of the brake angle acceleration thus calculated. According to this construction, not only the swing motion can be stopped but also the suspended article can be brought to a standstill, thus enhancing the safety to a greater extent.

Preferably, the swing type work machine is provided with a work radius detecting means for detecting an actual work radius of the swing member, a swing angle detecting means for detecting an actual swing angle of the swing member, and a display means which displays on a single display screen the relation of the safe work area outputted from the area data output means to actual work radius and swing angle.

According to this construction, the safe work area established in the above manner is displayed together with the current working condition, and thus useful information is provided to the operator of the work machine.

The display means may be of a construction wherein the safe work area is displayed three-dimensionally in a cylindrical coordinate system using as variables the work radius and swing angle of the swing member and the corresponding rated load, or it may be of a construction wherein a safe work area corresponding to an actual hoisting load is displayed on a polar coordinate plane using the work radius and swing angle of the swing member as variables. In the former case, the relation among the work radius, swing angle and rated load can be grasped at a glance, while in the latter case it becomes easier to grasp the relation between the current work position and the safe work area.

In the latter case, moreover, the larger the actual hoisting load, the more enlarged the display of the safe work area, whereby the safe work area can be displayed enlargedly to the maximum extent irrespective of changes in actual size of the same area, thus providing a display which is easy to see for the operator.

If the portion of the safe work area which has been established on the basis of the strength-based safe work area and the portion thereof which has been established on the basis of the stability-based safe work area are displayed in a distinguished manner, it becomes possible for the operator to judge exactly whether attention should now be paid to the strength or to the stability, thus permitting a more appropriate operation.

According to the present invention there also is provided a method of setting a rated load of a swing type work machine with an article suspended at a predetermined position of a swing member. According to this method, out of a strength-based rated load which is set taking the strength of the swing member into account and which is constant independently of the swing angle of the swing member, and a stability-based rated load which is set taking the stability of the work machine into account and which varies depending on the swing angle of the swing member, the lower one is adopted for each swing angle and is set as a rated load to be used actually.

According to the present invention there is further provided a swing type work machine for realizing the rated load setting method just mentioned above, with an article suspended at a predetermined position of a swing member. This swing type work machine is provided with a work radius detecting means for detecting a work radius of the swing member and a rated load data output means which outputs a rated load selected for each swing angle of the swing member as a rated load to be used actually, the said rated load being the lower one out of a strength-based rated load which is set taking the said work radius and the strength of the swing member into account and which is constant independently of the swing angel of the swing member and a stability-based rated load which is set taking the stability of the work machine into account and which varies depending on the swing angle of the swing member.

In the method and the swing type work machine adopting the said method, both described just above, there is used the smaller one selected from the strength-based rated load which is constant independently of the swing angle and the stability-based rated load which varies depending on the swing angle of the swing member, that is, a useful rated load matching the capacity of the actual crane is used.

Preferably, the rated load data output means has a memory which stores three-dimensional data using as variables to the work radius and swing angle of the swing member and a corresponding rated load, and it calculates and outputs a corresponding rated load from the work radius detected by the work radius detecting means. According to this construction, the rated load can be outputted rapidly on the basis of the stored data.

Where the swing type work machine is provided with outrigger jacks protruded in the horizontal direction, the above rated load data output means preferably has a memory which stores plural kinds of three-dimensional data according to protruded states of the outrigger jacks. This construction permits a rated load to be outputted rapidly which load is suitable for the actual protruded state of the outrigger jacks.

Preferably, the swing type work machine is provided with a hoisting load detecting means for detecting an actual hoisting load of the swing member, a swing angle detecting means for detecting an actual swing angle of the swing member, and a safety control means which makes control to let the work machine perform safe operations in accordance with a comparison between the rated load outputted from the rated load data output means and an actual hoisting load.

In this swing type work machine, an appropriate safety control is executed in accordance with the rated load calculated in the above manner.

A concrete example is making control to restrict the swing speed in accordance with a load factor which is the ratio of the actual hoisting load to the rated load. According to this construction, by restricting the swing speed to a great extent when the load factor is high, it is possible to restrict the deflection of a hoisted article and ensure a high safety. In this case, the gain of an actual swing speed relative to the amount of operation of a lever performed by the operator. But if the maximum swing speed alone is restricted, it becomes possible to make a swing control conforming to the operator's will when the lever is operated slightly to an extent not causing any obstacle in safety.

Preferably, the swing type work machine in question is provided with a hoisting load detecting means for detecting an actual hoisting load of the swing member, a swing angle detecting means for detecting an actual swing angle of the swing member, and a display means which displays the rated load outputted from the rated load data output means or a value related thereto (say a load factor).

According to this construction, the rated load which has been established in the above manner is displayed and there is provided information useful for the operator.

In this case, if a display is made in a distinguishable manner as to whether the displayed value is based on the strength-based rated load or on the stability-based rated load, it becomes possible for the operator to judge exactly whether attention should now be paid to the strength or to the stability, thus making it possible to perform a more appropriate operation.

DESCRIPTION OF A PREFERRED EMBODIMENT

A preferred embodiment of the present invention will be described hereinunder with reference to the accompanying drawings. Although a crane is disclosed herein as an example of a swing type work machine, the present invention is applicable to various work machines provided with a swing member.

Figure 1:
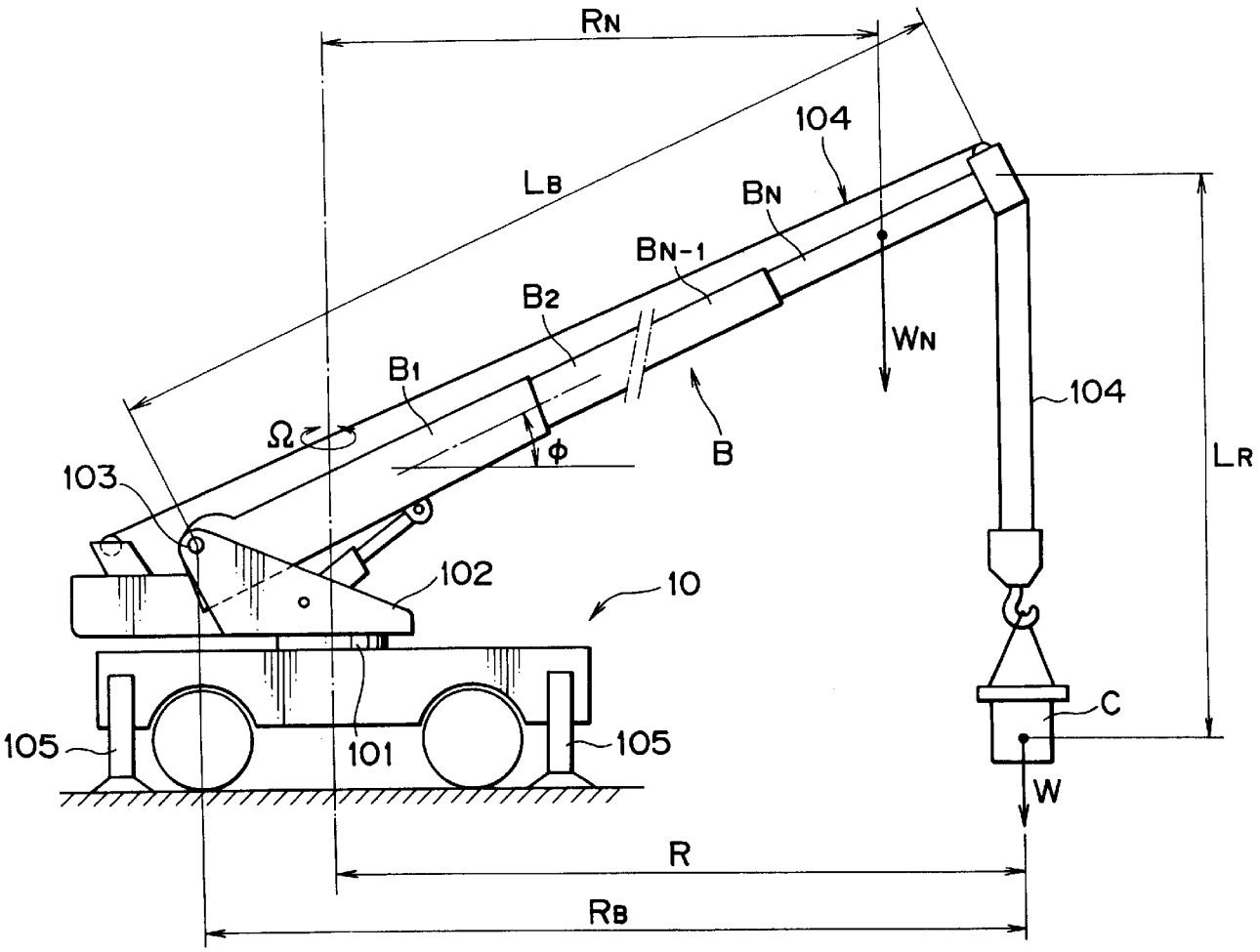
FIG. 1 is a side view of a crane according to an embodiment of the present invention.

A crane 10 shown in FIG. 1 is provided with a swing frame 102 which is swingable about a vertical swing shaft 101, and a boom B comprising N number of boom members B1 to BN and capable of expansion and retraction is attached to the swing frame 102. The boom B is constituted so as to be pivotable (capable of rise and fall) about a horizontal pivot shaft 103, and an article C is suspended at the tip (boom point) of the boom B through a hoisting rope 104. In the following description it is assumed that Bn (n=1, 2, . . . , N) indicates the $n^{th}$ boom member counted from the swing frame 102 side.

At the four, front, rear and right, left corners of a lower frame of the crane 10 are disposed outrigger jacks 105 which are protruded sideways. It is optional whether the outrigger jacks 105 are to be set each individually or all uniformly with respect to the amount of their horizontal protrusion. In the case of a large-sized crane, the number of outrigger jacks may be larger, and the outrigger jacks may protrude obliquely sideways.

Figure 2:
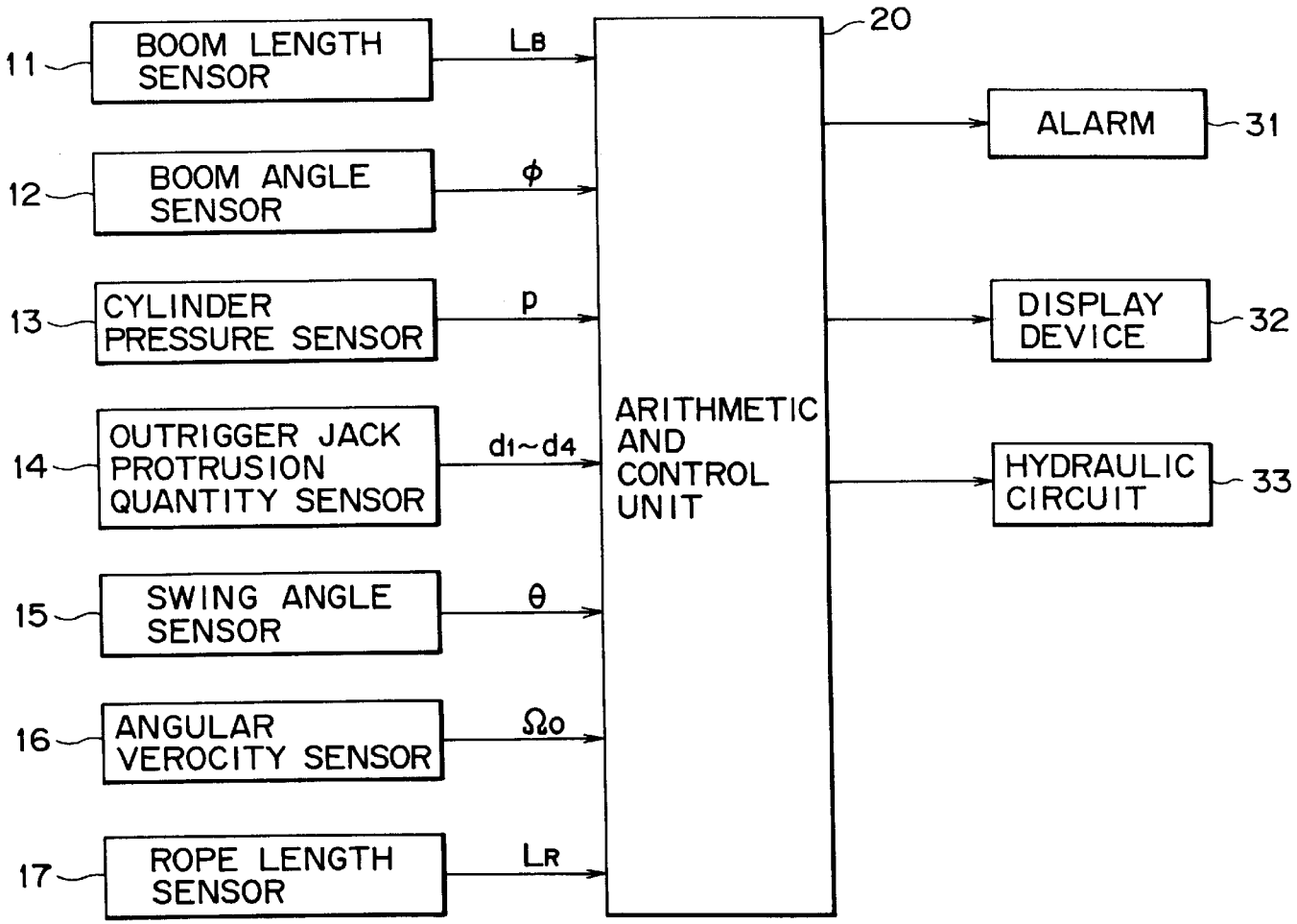
FIG. 2 is a hardware block diagram showing an input-output relation of an arithmetic and control unit installed in the crane.

In the crane 10, as shown in FIG. 2, there are disposed a boom length sensor 11, a boom angle sensor 12, a cylinder pressure sensor 13, outrigger jack horizontal protrusion quantity sensors 14, a swing angle sensor 15, a swing angular velocity sensor 16, and a rope length sensor 17. Detected signals provided from these sensors are inputted to an arithmetic and control unit 20, which in turn outputs control signals to an alarm 31 such as a lamp, a buzzer or any other audio output device, also to a display device having a display screen such as LCD or CRT, and further to an electromagnetic proportional valve or the like used in a hydraulic circuit 33 for swing drive.

Figure 3:
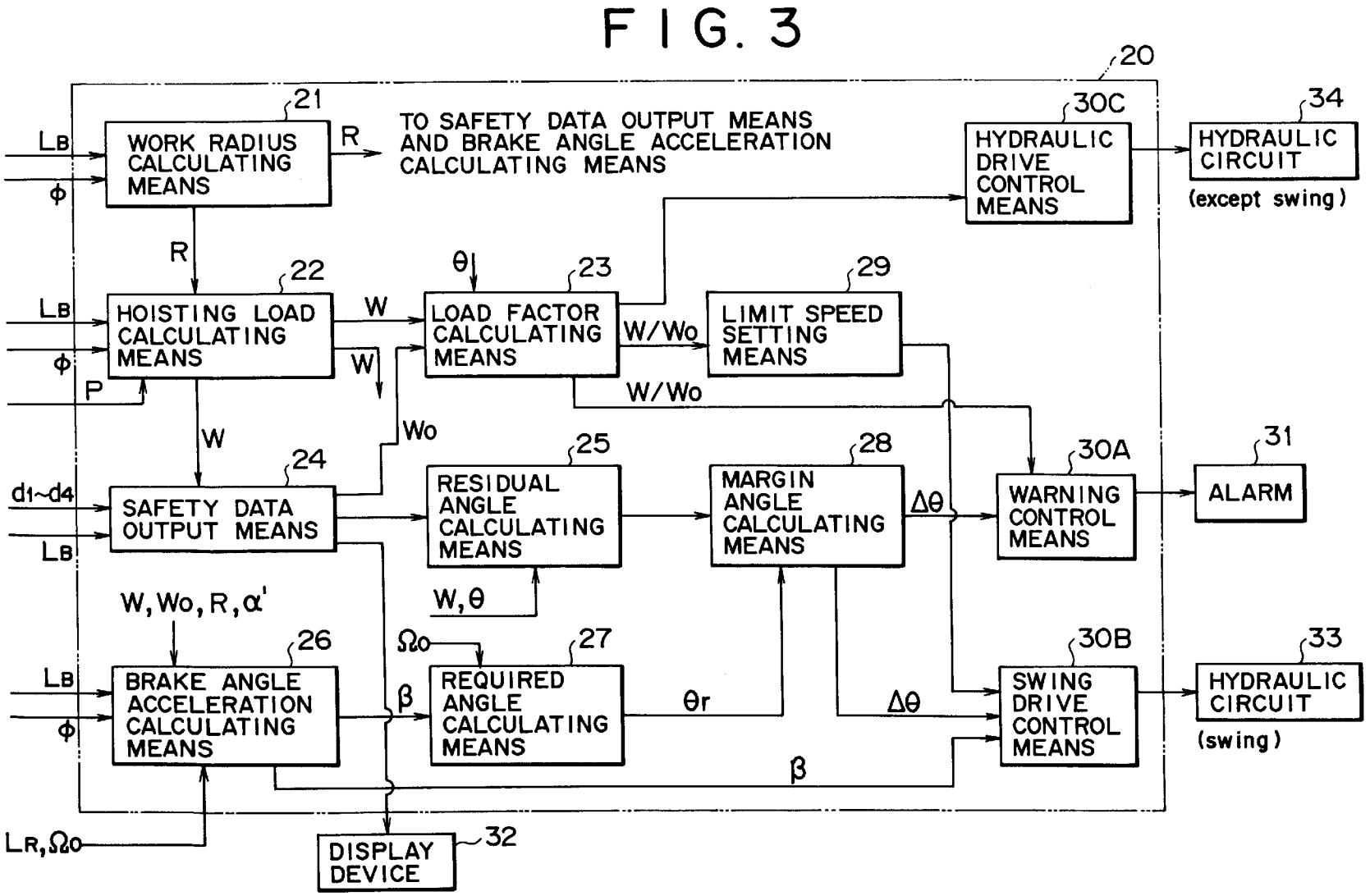
FIG. 3 is a functional block diagram of the arithmetic and control unit.

FIG. 3 shows a functional configuration of the arithmetic and control unit 20. As shown in the same figure, the arithmetic and control unit 20 is provided with a work radius calculating means 21, a hoisting load calculating means 22, a load factor calculating means 23, a safe data output means 24, a residual angle calculating means 25, a brake angle acceleration calculating means 26, a required angle calculating means 27, a margin angle calculating means 28, a limit speed setting means 29, a warning control means 30A, a swing drive control means 30B, and a hydraulic drive control means 30C.

In FIG. 3, the work radius calculating means 21, which constitutes a work radius detecting means, calculates a work radius R of the suspended article C on the basis of boom length LB and boom angle $\phi$ detected respectively by the boom length sensor 11 and the boom angle sensor 12. The hoisting load calculating means, which constitutes a hoisting load detecting means, calculates a load W based on the article C hoisted actually in accordance with the boom length LB, boom angle $\phi$, and a cylinder pressure, p, of the boom upper detected by the cylinder pressure sensor 13.

The load factor calculating means 23 calculates the ratio of the actually hoisted load W to a rated load Wo at each swing angle $\theta$ outputted from the data output means 24 which will be described later, namely, a load factor W/Wo, on the basis of the data on the hoisting load W of the boom B calculated by the hoisting load calculating means 22, the swing angle $\theta$ detected by the swing angle sensor 15, and the said rated load Wo.

The data output means 24 has a memory which stores three-dimensional data using as variables the three data of the above work radius R, swing angle $\theta$ and rated load Wo. On the basis of the said three-dimensional data the data output means 24 calculates and outputs a whole circumference rated load Wo (Wo is a function of the swing angle $\theta$) which correspondings to the current work radius R, and also calculates a whole circumference limit work radius (a work radius based on the assumption that the current hoisting load W is the rated load Wo) Ro (Ro is a function of the swing angle $\theta$) corresponding to the current hoisting load W and outputs it as data on a safe work area.

In this embodiment, the memory of the data output means 24 can store plural kinds of three-dimensional data according to protruded states of the outrigger jacks 105 and boom lengths. The data output means 24 is constituted so as to access three-dimensional data corresponding to horizontal protrusion quantities d1~d4 of the outrigger jacks 105 detected actually by the outrigger jack horizontal protrusion quantity sensor 14 and boom length LB and then calculate the rated load Wo and safe work area on the basis of the three-dimensional data.

Figure 4:
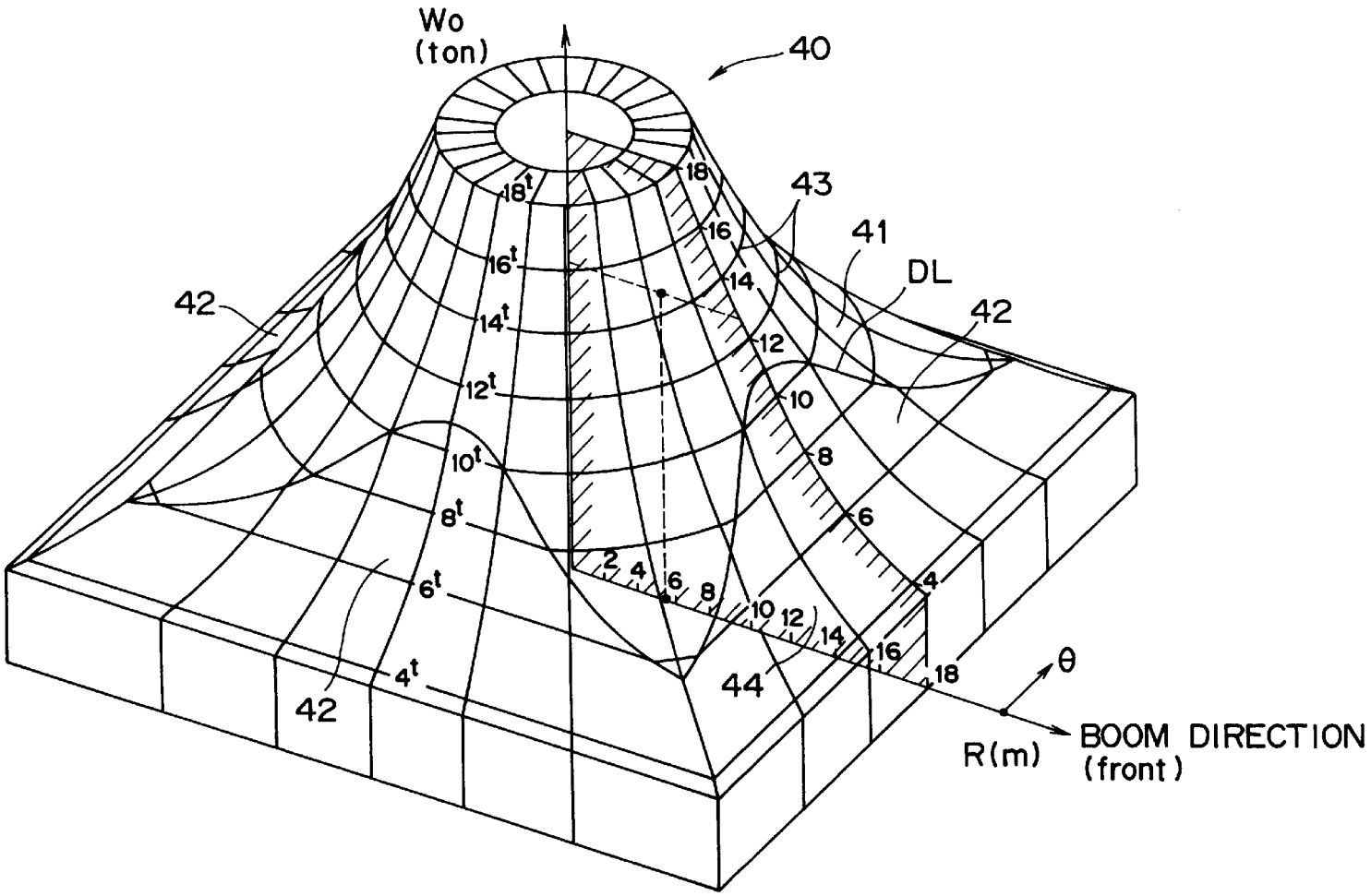
FIG. 4 is a three-dimensional diagram showing three-dimensional data stored in the arithmetic and control unit.

An example of such three-dimensional data is shown in FIG. 4 as a three-dimensional data corresponding to a fully protruded state of all the outrigger jacks 105. The three-dimensional data 40 is represented in a cylindrical coordinate system using Wo, out of R, $\theta$ and Wo, as a vertical axis. In this coordinate system, a strength-based safe work area 41, which is set on the basis of the strength of the boom B for example, is represented in a three-dimensional, cone-like shape as a whole having a circular horizontal section, while a stability-based safe work area 42, which is set on the basis of the stability of the crane, is represented in a three-dimensional, quadrangular pyramid-like shape as a whole surrounded with lines parallel to tipping lines in various directions and having a square (rectangular in the figure) horizontal section. An area where the strength-based safe work area 41 and the stability-based work area 42 overlap each other is set as such a final safe work area as illustrated in the figure.

In this figure, the reference mark DL denotes a boundary line between both areas 41 and 42, and the numeral 43 denotes a contour line of each rated load (4 ton, 6 ton, 8 ton, . . . in the figure). The boundary line DL may be a line literally, or it may be rounded for smooth shift between both areas 41 and 42.

Figure 5:
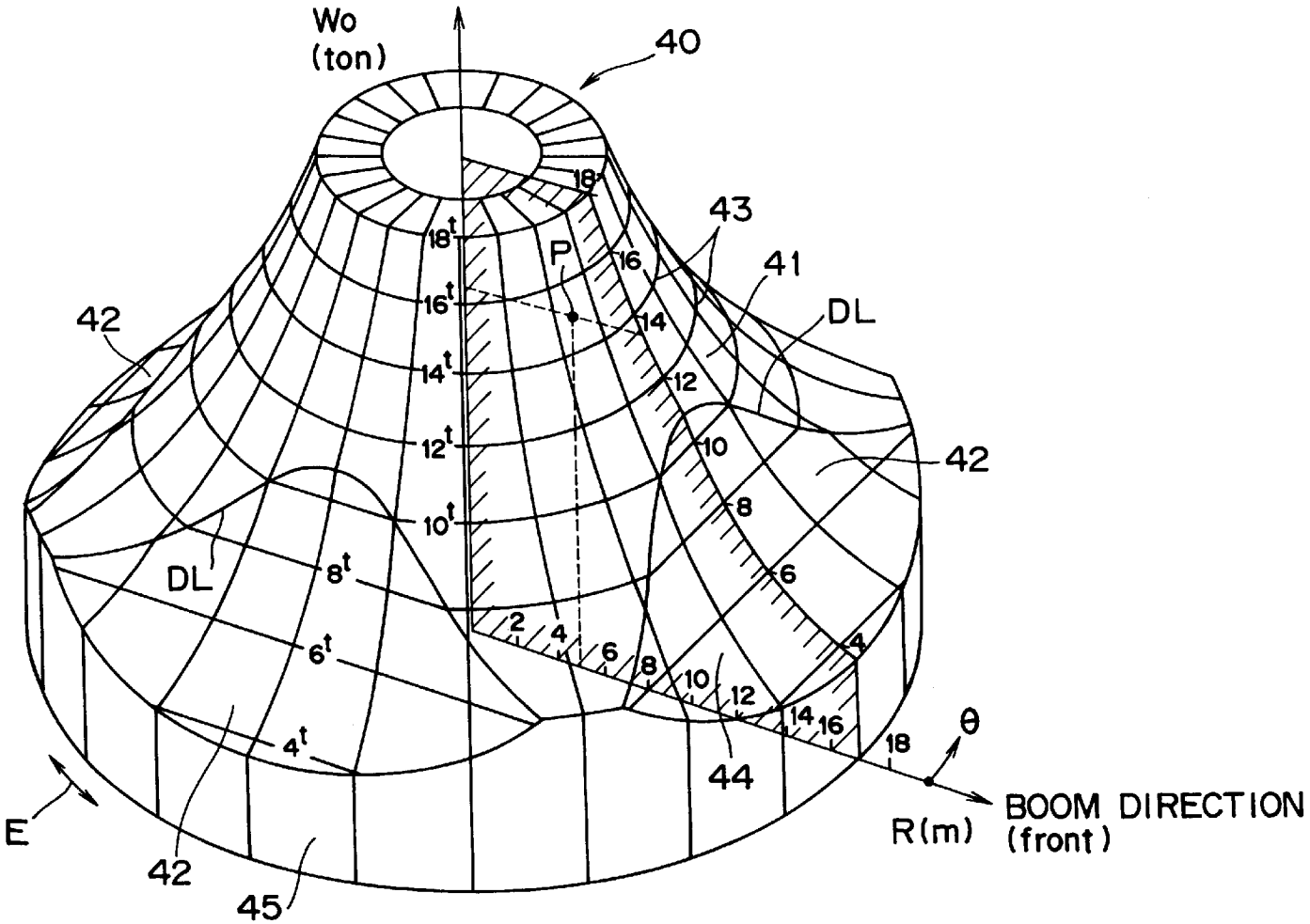
FIG. 5 is a diagram showing a modification of the three-dimensional data.

More preferably, taking the maximum work radius of the boom B into account, the three-dimensional data 40 is assembled so that a safe work area is set inside the said maximum work radius, that is, within a cylinder having a radius corresponding to the said maximum work radius. The thus-assembled three-dimensional data 40 is shown in FIG. 5. The safe work area shown in this figure has a shape obtained by cutting off the outer peripheral portion of the safe work area shown in FIG. 4 by means of a cylinder having radius equal to the maximum work radius. A cylindrical surface 45 represents a cut end.

In FIG. 5, assuming that the current work point (boom point) is represented by point P, then on a section 44 which includes both point P and Wo axis, the height (Wo coordinates) of a point where a straight line extending just above from the point P and a three-dimensional surface indicative of the safe work area intersect each other is the rated load Wo. Likewise, R coordinates of a point where a straight line extending horizontally in a radially outward direction from the point P and a three-dimensional surface indicative of the safe work area intersect each other correspond to the limit work radius Ro at that work point.

It is to be understood that the "three-dimensional data" as referred to herein is not limited to only those stored as three-dimensional images in the memory but widely indicate combined data using the three variables of work radius R, swing angle θ and rated load Wo. For example, the relation among R, θ and W may be stored in terms of a functional expression. According to another method, the work radius R for each unit swing angle (say 1°) proportional to work conditions such as boom length LB and outrigger jack protrusion quantity is tabulated as a data table, then plural such tables are stored together as a data map, and a middle point is determined by interpolatory calculation. In the case where the data in question are to be used for control actually in each individual work machine, the latter method just referred to above is advantageous in that the time required for calculation can be made shorter than in the former method (calculation using a functional expression).

The residual angle calculating means 25 calculates a residual angle θ c at which the boom B can swing within the safe work area from its current position.

On the basis of the work radius R, boom length LB, boom angle ϕ, and angular velocity Ωo and hoisted article deflection diameter LR which are detected by the angular velocity sensor 16 and the rope length sensor 17, respectively, the brake angle acceleration calculating means 26 calculates a brake angle acceleration β which does not cause deflection of the suspended article C when the swing motion stops and which takes into account a lateral bending strength of the boom B against an inertia force in forced stop.

On the basis of the angular velocity Ωo before the start of swing control, the required angle calculating means 27 calculates a swing angle (required angle) θr of the boom B during the period from time when braking is started at the brake angle acceleration β until when the swing motion stops. The margin angle calculating means 28 calculates a margin angle Δθ which is the difference between the residual angle θc and the required angle θr.

The limit speed setting means 29 calculates a limit value of the maximum swing speed on the basis of the load factor W/Wo calculated by the load factor calculating means 23. As to the contents of the calculation, it will be described in detail later.

① When the load factor W/Wo calculated by the load factor calculating means 23 has become 90% or more and ② when the margin angle Δθ calculated by the margin angle calculating means 28 has becomes a predetermined value or less, the warning control means 30A outputs a control signal to the alarm 31, causing the alarm to issue a warning.

The swing drive control means (safety control means) 30B outputs a control signal to, for example, an electromagnetic proportional valve included in the hydraulic circuit 33 for swing drive, thereby making a swing drive control for a rotatable superstructure. In normal operation, a control responsive to the contents of operation conducted by the operator is made within a swing speed range not exceeding the limit speed set by the limit speed setting means 29, and when the margin angle Δθ has become zero, a swing brake for the boom B is started at the brake angle acceleration β. On the other hand, the hydraulic drive control means 30C outputs a control signal to an electromagnetic proportional valve included in the hydraulic circuit 34 which is for creating a motion (say rise and fall of the boom) other than the swing motion, thereby controlling the same valve.

The following description is now provided about arithmetic and control operations carried out actually by the arithmetic and control unit 20.

A. Arithmetic and Control relating to the Load Factor

First, on the basis of the boom length LB and boom angle ϕ the work radius calculating means 21 determines a work radius R' not taking the deflections of the boom B, frame and outrigger jacks into account and an error ΔR caused by the deflections of the boom B, frame and outrigger jacks, and calculates the work radius R from both R' and ΔR. On the basis of the thus-calculated work radius R, boom length B and cylinder pressure p the hoisting load calculating means 22 calculates the load W of the article C hoisted actually.

The data output means 24 selects three-dimensional data 40 corresponding to the current horizontal protrusion quantities d1~d4 of the outrigger jacks 105 and the current boom length LB and, on the basis of the data thus selected, calculates the rated load Wo throughout the whole circumference in the form of a function, f(θ, R), of the swing angle and work radius. (Of course, only the rated load Wo corresponding to the current swing angle θ and work radius R may be calculated every moment.) As to the rated load Wo thus calculated, out of a strength-based rated load (a constant rate load throughout the whole circumference independently of the swing angle) which is set taking the strength of the boom B into account and a stability-based rated load (a rated load small in the longitudinal and transverse directions and large in obliquely front and rear directions where the outrigger jacks are located) which is set taking the stability of the crane into account, the smaller load is the rated load adopted for each swing angle θ and work radius R. Thus, there is obtained an appropriate rated load matching the hoisting capacity of the crane used actually.

The load factor calculating means 23 calculates the load factor W/Wo on the basis of the rated load Wo and hoisted load W corresponding to the current swing angle θ and work radius R.

If the load factor W/Wo is 90% or more, the alarm 31 issues a warning upon receipt of an output signal from the warning control means 30A, so that the operator can become aware that the load W based on the hoisted article C is close to the rated load Wo. If the load factor W/Wo exceeds 100%, that is, if the actual load W exceeds the rated load Wo, not only the alarm operates but also a control signal is outputted from the hydraulic drive control means 30C in FIG. 3 to the hydraulic circuit 34, whereby crane motions by actuators in the hydraulic circuit 34, namely, crane motions (extension, rise and fall of the boom B, hoisting of the article C) except swing motion are stopped forcibly.

On the other hand, in the limit speed setting means 29, a limit value of the maximum swing speed is calculated on the basis of the load factor W/Wo. More specifically, the limit speed setting means 29 stores such a relation between the load factor W/Wo and a maximum speed limit coefficient K as shown in FIG. 6, in the form of, for example, a mathematical expression or a map, then calculates the maximum speed limit coefficient K corresponding to the inputted load factor W/Wo, then multiplies this value K by the maximum swing speed, and outputs the resulting value as a limit speed to the swing drive control means 30B.

Figure 6:
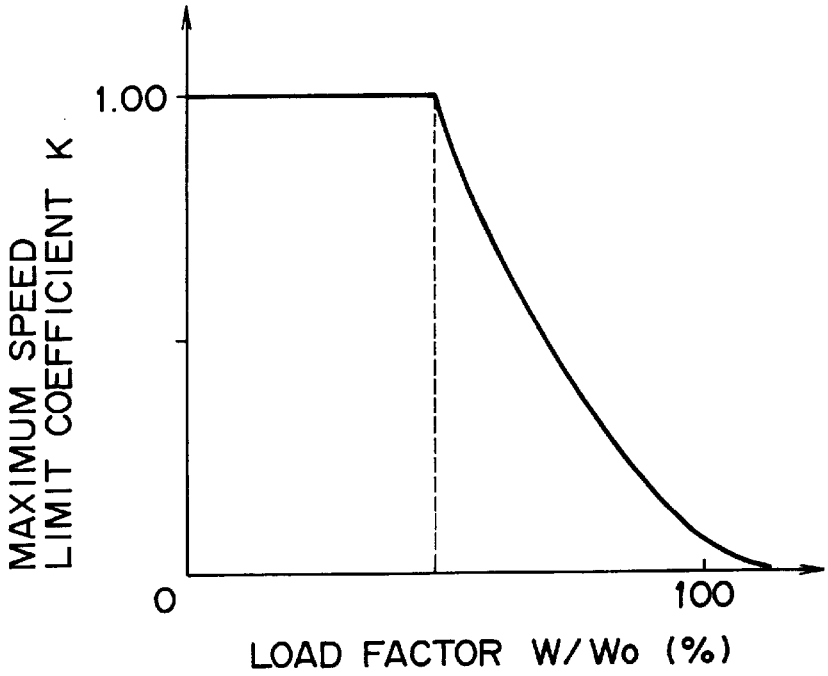
FIG. 6 is a graph showing a relation between a maximum speed limit coefficient and a load factor, which is stored in the arithmetic and control unit.

In this embodiment, as shown in FIG. 6, the maximum speed limit coefficient K is set to 1 in the region wherein the load factor is below 50%. That is, the limitation of the maximum swing speed is not performed. On the other hand, in the region where the load factor is above 50%, the maximum speed limit coefficient K decreases as the load factor increases, and the degree of limitation on the maximum swing speed becomes larger. During operation at a high load factor, the boom B swings only at a low speed even if the operator fully operates the swing lever, thus ensuring high safety. Besides, this limitation is for the maximum swing speed and therefore as long at the operator operates the swing lever only a small amount, a swing control is made at a speed matching the amount of operation of the lever and thus priority is given to the operator's will.

For actually limiting the maximum speed as above, a limitation may be placed on the control signal provided from the swing drive control means 30B to, for example, the electromagnetic proportional valve in the hydraulic circuit 33, or an electromagnetic proportional valve may be incorporated beforehand in the hydraulic circuit 33 and a control signal for limitation may be applied to the electromagnetic proportional valve during operation at a high load factor.

B. Arithmetic and Control Relating to the Safe Work Area

Figure 10:
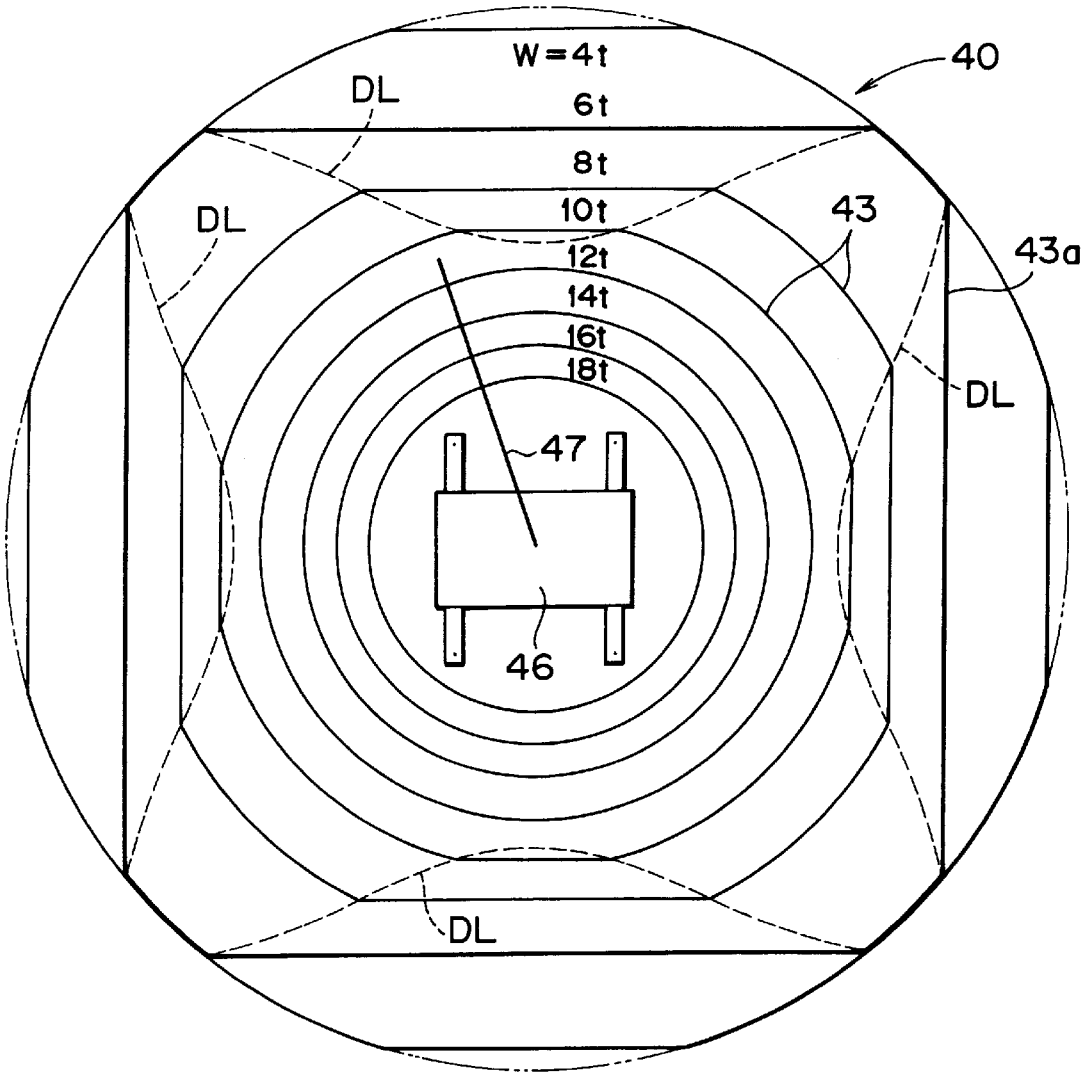
FIG. 10 is a diagram showing a second display example.

The data output means 24 outputs a safe work area proportional to the hoisting load W, horizontal protrusion quantities d1~d4 of the outrigger jacks 105, and boom length LB. This safe work area corresponds to a horizontal section obtained by cutting the three-dimensional body shown in FIG. 5 horizontally at a vertical position corresponding to the current hoisting load W. When this FIG. 5 is seen planarly from above, the result is like FIG. 10. In FIG. 10, the numeral 43 denotes a contour line at each of various rated loads (4 ton, 6 ton, 8 ton, . . . ). The contour line 43 as it is serves as an external-form line of the safe work area corresponding to each of various hoisting loads. The safe work area in question is a lapped area between a circular strength-based safe work area wherein the limit work radius Ro is constant independently of the swing angle θ and a stability-based safe work area or an irregular shape surrounded with straight lines (or similar lines) parallel to front, rear and right, left tipping lines. Therefore, in the case of a relatively small hoisting load W, the safe work area assumes a shape obtained by cutting the four corners of the stability-based safe work area which is in a generally square shape with use of a circle having the maximum work radius or a circle indicative of the strength-based safe work area. In the case of a large hoisting load W, the safe work area assumes the shape of the very strength-based safe work area (namely, a cylindrical area). The safe work area thus established is an appropriate area matching the actual capacity of the crane used, allowing the hoisting capacity of the crane to be exhibited to the utmost extent.

On the other hand, the brake angle acceleration calculating means 26 calculates, through the following procedure, the brake angle acceleration β which takes the lateral bending strength of the boom B and which does not cause a deflection of the hoisted article.

① Calculating the moment of inertia of the boom

The moment of inertia, In, of each boom member Bn is calculated in accordance with the following expression:

$$In = Ino \cdot \cos^2 \phi + (Wn/g) \cdot Rn^2 \quad (1)$$

Where, Ino stands for a moment of inertia (a constant) around the center of gravity of each boom member Bn, Wn stands for own weight of each boom member Bn, g stands for a gravitational acceleration, and Rn stands for a swing radius of the center of gravity of each boom member Bn.

② Calculating an allowable angular acceleration

An allowable angular acceleration $\beta_1$ is calculated in the following manner.

Generally, the boom B and swing frame 102 of the crane 10 have a sufficient strength, but as the boom length $L_B$ becomes larger, a large lateral bending force acts on the boom B which is attributable to the force of inertia generated at the time of swing brake. A strength-related burden caused by such lateral bending force is the largest in the vicinity of the swing frame 102 and therefore the evaluation of strength is here made on the basis of the moment created around the swing shaft.

More specifically, given that the angular acceleration of the boom B at the time of swing brake is β' and the swing angle acceleration of the suspended article C is β", the moment $N_B$ caused by rotation of the boom B and acting on the center of the rotation is represented by the following expression (2):

$$N_B = (W/g)R^2\beta'' + \sum_{n=1}^{N} In\beta' \quad (2)$$

Where, W stands for a hoisting load calculated by the hoisting load calculating means 22. Given that the rated load relating to the lateral bending strength of the boom B is Wo'(=Wo·α', α' being a safety factor), an allowable condition for this strength is represented by the following expression (3):

$$N_B/R_B \leqq Wo \text{ where } R_B = L_B \cos \phi \quad (3)$$

Substitution of the foregoing expression (2) into this expression (3) gives the following expression (4):

$$(W/g)R^2\beta'/R_B + \sum_{n=1}^{N} In\beta'/R_B \leq Wo' \quad (4)$$

Thus, the maximum angular acceleration β' which satisfies this expression (4) can be set as the allowable angular acceleration $\beta_1$.

The rated load Wo' may be set at a certain value, but it also may be set at a smaller value as the boom length $L_B$ and work radius R become larger, take the deflection of the like of the boom B into account.

③ Calculating the actual angular acceleration

The actual brake angle acceleration β is calculated on the basis of the allowable angular acceleration $\beta_1$ calculated in the above manner and the boom angular velocity (before deceleration) Ωo and hoisted article deflection diameter LR both obtained from the results of detection made by the angular velocity sensor 16 and rope length sensor 17.

Figure 7:
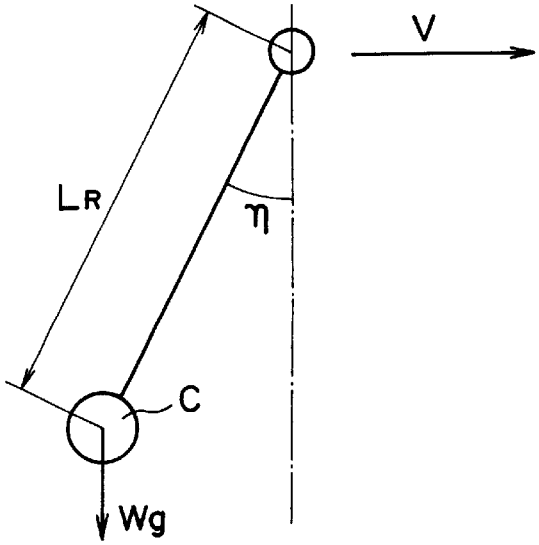
FIG. 7 is an explanatory diagram showing the state of a suspended article as a simple pendulum.
Figure 8:
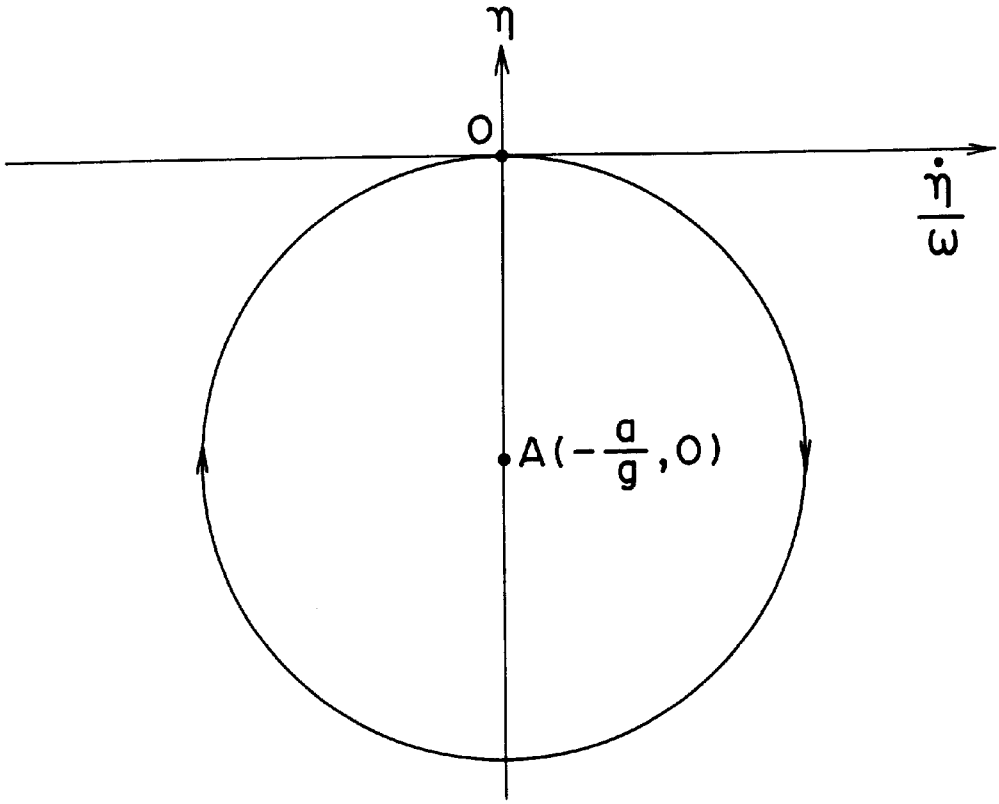
FIG. 8 is a graph showing on a phase space an expression relating to a deflection angle and a deflection speed of the suspended article.

This calculation is conducted in the following manner. First, with respect to the article C suspended in the crane 10, a model of such a simple pendulum as shown in FIG. 7 is considered. Differential equations of this system are given by the following expressions (5) and (6):

$$\eta + (g/L_R)\eta = -\dot{V}/L_R \quad (5)$$

$$V = Vo + at \quad (6)$$

Where, η stands for the deflection angle of the hoisted article C, V stands for the swing speed of a boom point which varies with time, t, $V_o$ stands for the swing speed (=RΩo) before the start of swing stop of the boom point, and a stands for an acceleration thereof. If both sides of the above expression (5) is differentiated by time, t, followed by substitution into the right side of the same expression and subsequent integration under initial conditions of (t=0, η=0, dη/dt=0), there is obtained the following expression (7):

$$(\eta + a/g)^2 + (\dot{\eta}/\omega)^2 = (a/g)^2 \text{ where } \omega = \sqrt{g/L_R} \quad (7)$$

If this expression is expressed on a phase plane relating to (dη/dt)/ω, there is described a circle centered at point A (−a/g, 0) and passing through the origin O (0,0). The time required for circulating this circle, namely, the period T from the time when the state of the simple pendulum changes from the origin O up to time when it reverts to the original state, is given as $T=2\pi/\omega$, so if the angular acceleration $\beta$ is set so as to reach a complete stop in time nT (n is a natural number) after the time point (point O) at which the crane began to stop rotation, it is possible to stop the crane without any residual deflection of the hoisted article. On the other hand, since the above $\omega$ is a constant value determined by both gravitational acceleration, g, and deflection diameter LR, an angular acceleration $\beta$ which permits a rotation stop free of any article deflection can be obtained by the following expressions:

$$\beta=-\Omega o/nT=-\omega\Omega o/2n\pi \text{(n is a natural number.)} \quad (8)$$

As to the lateral bending strength of the boom B, there exists the condition of $|\beta|\leqq\beta 1$, therefore by selecting a minimum natural number, n, in the range which satisfies the said condition, it is possible to obtain an actual brake angel acceleration $\beta$ for stopping the crane without hoisted article deflection and in a minimum time required.

On the basis of the current angular velocity (before braking) $\Omega o$ the required angle calculating means 27 calculates a swing angle (required angle) $\theta$ r necessary from the start of braking until complete stop in the case where the stop of rotation is conducted at the above brake angle acceleration $\beta$. More specifically, if the time required from the start of braking until complete stop is assumed to be t, there exist the following two expressions:

$$\Omega o+\beta t=0, \theta r=\beta t^2/2+\Omega ot \quad (9)$$

Therefore, the required angle $\theta$ r can be obtained by eliminating t from both expressions.

The margin angle calculating means 28 calculates the angle at which rotation can be done at the current angular velocity $\Omega o$ until the start of braking, i.e., margin angle $\Delta\theta$ ($=\theta c-\theta r$).

The swing drive control means 30B outputs a control signal to the hydraulic circuit 33 when the margin angle $\Delta\theta$ thus calculated has become zero, thereby making a swing brake for the boom B and a forced stop of operation involving an increase in work radius from the current radius. At this time, for preventing deflection of the suspended article C, a hydraulic motor pressure PB is set so as to stop at the foregoing brake angle acceleration $\beta$.

An example of how to calculate the hydraulic motor pressure PB will now be shown. If the sum total of inertia moments related to the other components of the rotatable superstructure than the boom B is assumed to be Iu, the torque TB necessary for swing brake is given by the following expression (10):

$$T_B=\left|(W/g)R^2\beta+\sum_{n=1}^{N} In\beta+Iu\beta\right| \quad (10)$$

The acceleration $\beta''$ of the hoisted article C can be expressed in terms of the following expression by solving the foregoing expressions (3) and (5) at $\eta=0$ and $d\eta/dt=0$ under the initial condition of t=0, though the details are here omitted:

$$\beta''=(1-\cos\omega t)-\beta \quad (11)$$

On the other hand, the torque TB is approximately in the relation of the following expression to the conditions adopted on the hydraulic motor side, through the details are here omitted:

$$T_b=(P_B\cdot Q_h/200\pi)i_o/\eta_m \quad (12)$$

$Q_h$: motor capacity $i_o$: total deceleration ratio $\eta_m$: mechanical efficiency Therefore, by substituting this expression (12) into the above expression (10), it is possible to obtain the actual hydraulic motor pressure PB.

On the other hand, when the margin angle $\Delta\theta$ has become a predetermined value or smaller, not zero, the warning control means 30A outputs a control signal to the alarm 31, causing the alarm to issue a warning. Consequently, the operator can become aware that braking will be applied automatically after a slight rotation.

C. Display Control

Further, the arithmetic and control unit 20 outputs information signals on various values to the display device 32 and provides useful information to the operator. As to the contents of the display, various modes are conceivable. Several examples will be given below.

Figure 9:
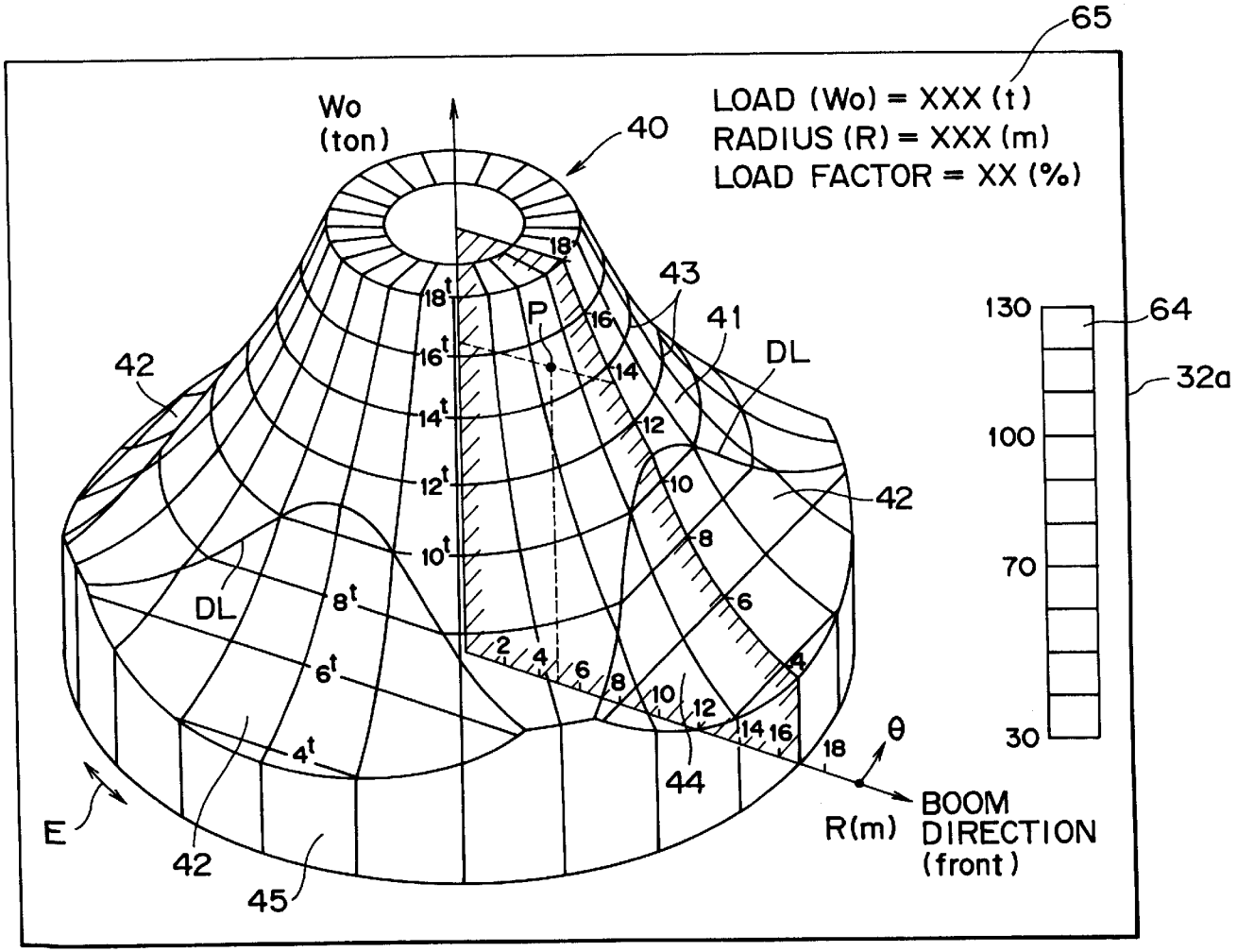
FIG. 9 is a diagram showing a first display example.

1) First Display Example (FIG. 9)

According to this display example, the three-dimensional data 40 shown in FIG. 5 is displayed as it is, as a safe work area, in a cylindrical coordinate system using R, $\theta$ and Wo as variable. In a display screen 32*a* illustrated in FIG. 9, an angular position corresponding to the current swing angle $\theta$ is expressed by a section 44, and a point P corresponding to the current hoisting load W and work radius R is spot-displayed within the section 44.

In this display screen, since R and W coordinate axes are fixed, the three-dimensional portion rotates about the W coordinate axis (vertical axis) (in the direction of arrows E). The position of the point P shifts horizontally with changes of the boom length and boom rise/fall angle and shifts vertically as the hoisting load W changes. A correlation between the actual work position and the safe work area can be grasped always at a glance. When the protruded state of the outrigger jacks changes, the three-dimensional data 40 also changes and the display on the screen is switched over immediately.

According to such a three-dimensional display, not only the current load factor at the current work posture can be grasped, but also it is possible to grasp how the safe work area was changed after the swing motion.

Figure 11:
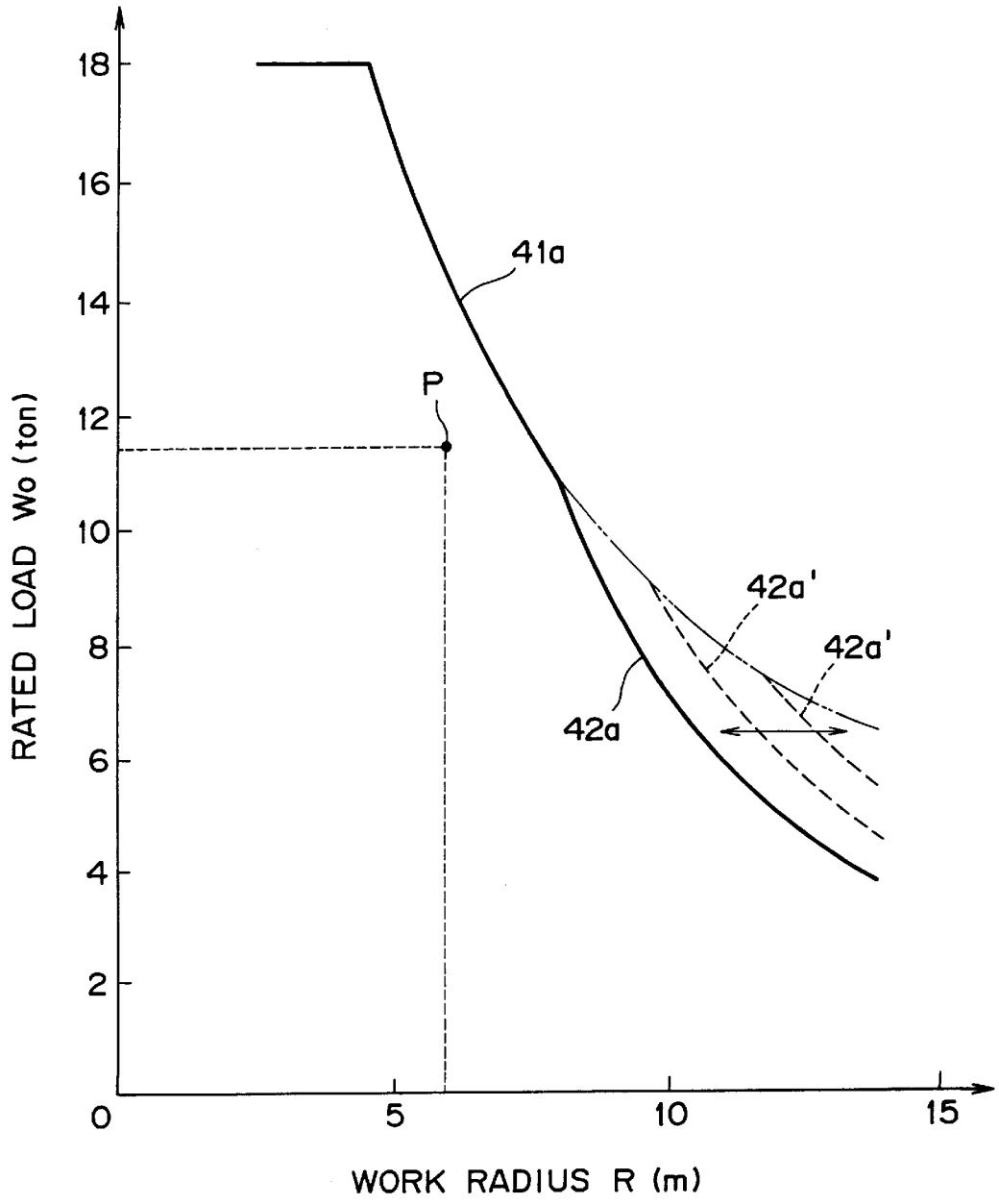
FIG. 11 is a diagram showing a third display example.

For example, in the case where the boom hoists an article of a maximum load factor falling under the safe work area at a swing angle corresponding to an oblique direction of the crane (a direction where an outrigger jack is present), (for example, when P1 is positioned between 42*a* and 42*a*" in FIG. 11), since the stability is higher in the said direction than in sideways directions, the point of the current load factor P1 is displayed on the section 44 in the display screen and within a workable safe work area 42*a*'. At the same time, the entire safe work area 45 including angles around the said swing angle. Therefore, the operator can easily understand that if the swing motion is performed at the current posture as it is, the safe work area will become narrower. On the basis of this understanding the operator can perform an appropriate operation of the crane.

If a color liquid crystal monitor or the like is used as display means to display the strength-based safe work area 41 and the stability-based safe work area 42 distinguishably using different colors or example, it becomes possible for the operator to judge correctly whether attention should now be paid to the strength or to the stability and hence possible to effect a more appropriate operation.

As shown in FIG. 9, if there is provided a load factor display portion 64 of a color bar display whose color and position change depending on the load factor, or if there is provided a numerical value display portion 65 which displays concrete current state values (e.g. hoisting load W, work radius R, load factor), the display screen can be made more useful.

2) Second Display Example (FIG. 10)

In this display example, the three-dimensional data 40 is displayed planarly on the R−θ polar coordinate plane. As shown in FIG. 10, safe work areas corresponding to various hoisting loads may be displayed overlappedly as contour lines 43 and only the line corresponding to the current hoisting load may be displayed with a thick line (in the same figure the line of 6-ton hoisting load is displayed with a thick line 43*a*). Alternatively, only the safe work area corresponding to the current hoisting load may be displayed. In the latter case, if the safe work area is displayed on a larger scale as the hoisting load W becomes larger, that is, as the safe work area becomes narrower, thereby allowing the safe work area to be displayed always throughout the whole display screen, the display screen becomes easier to see for the operator. Also in this case, as is the case with the above first display example, if a color liquid crystal monitor or the like is used to effect a distinguished display using different colors for example, it becomes possible to display the strength-based safe work area and the stability-based safe work area in a clearly distinguished manner with curve DL as the boundary, thus making it possible to provide a more appropriate information to the operator.

In this display screen, if there is displayed a picture 46 which centrally shows the crane simulationwise or a segment 47 which shows the work radius and swing angle, the operator can grasp at a glance to what degree the current state of operation is safe. Further, in order for the direction of the rotatable superstructure in the actual work machine to match the image on the display screen, if for example the schematic diagram of the lower portion of the crane and the safe work area are rotated with rotation of the machine while the said direction is fixed, it becomes easier to recognize intuitively the actual direction of the rotatable superstructure in the crane and the display.

3) Third Display Example (FIG. 11)

This display example is the display of only the portion of the section 44 in FIG. 5 as an orthogonal coordinate plane of R−W. In this display example, a curve 41*a* which indicates the strength-based safe work area does not change even if the swing member rotates, but the curve 42*a* which indicates the stability-based safe work area changes in the swing radius direction with the said rotation (see the curves 42*a*' and 42*a*"). Also in this case, by displaying the curves 41*a* and 42*a* distinguishably using different colors for example, it becomes possible for the operator to judge exactly whether attention should now be paid to the strength or to the stability.

4) Fourth Display Example (FIG. 12)

Figure 12A:
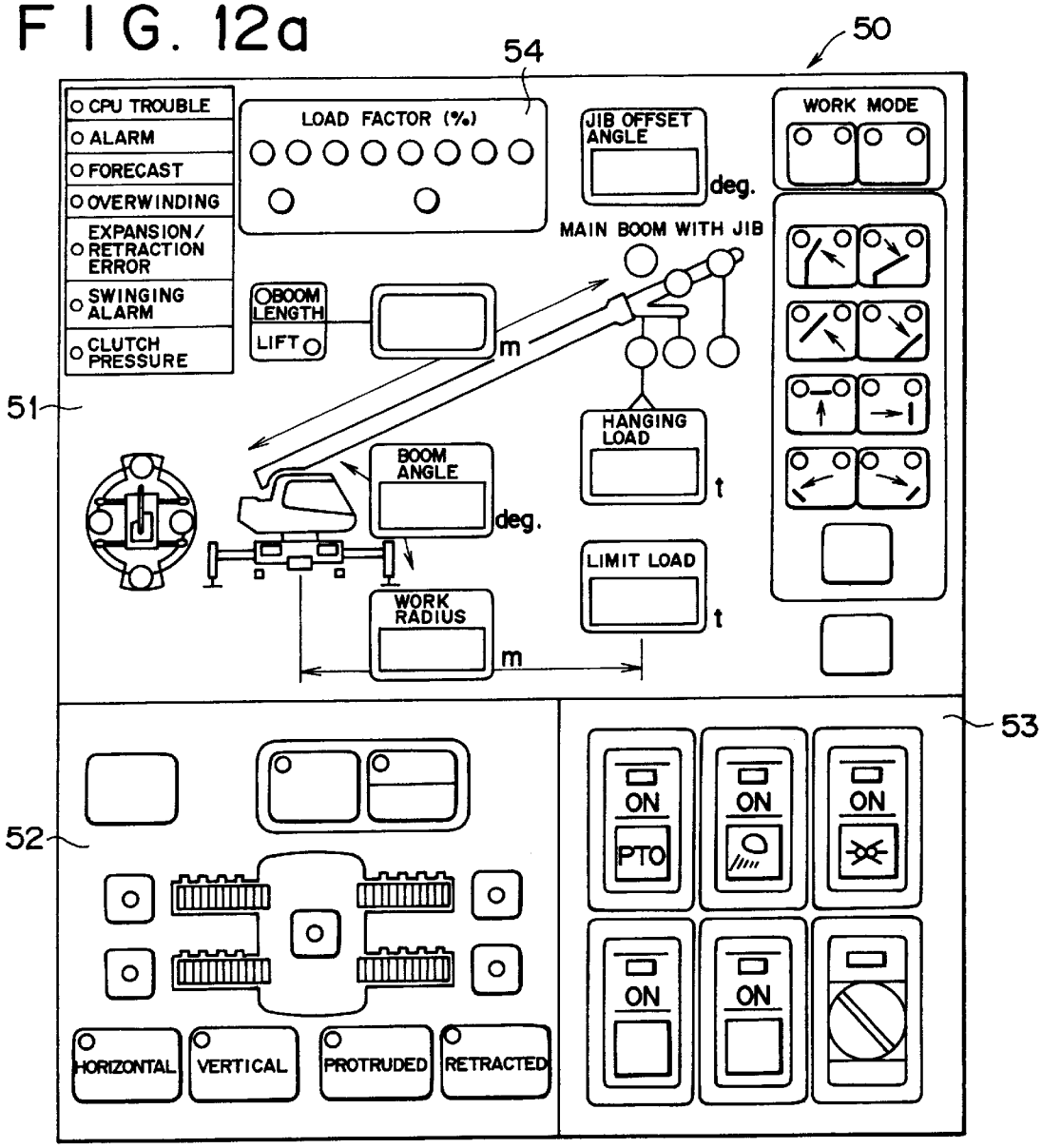
FIG. 12*a* is a front view of a display panel showing a fourth display example.
Figure 12B:
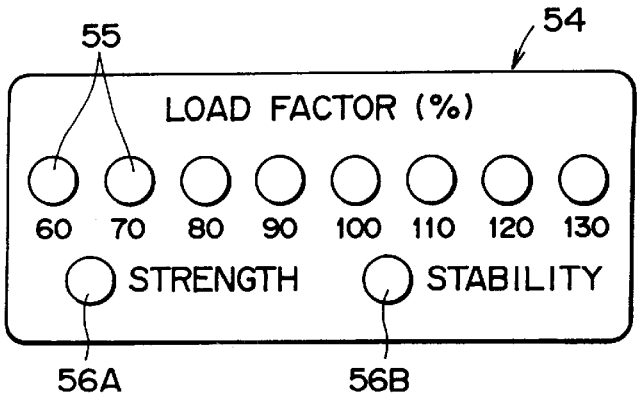
FIG. 12*b* is a front view of a load factor display portion of the said display panel.
Figure 13:
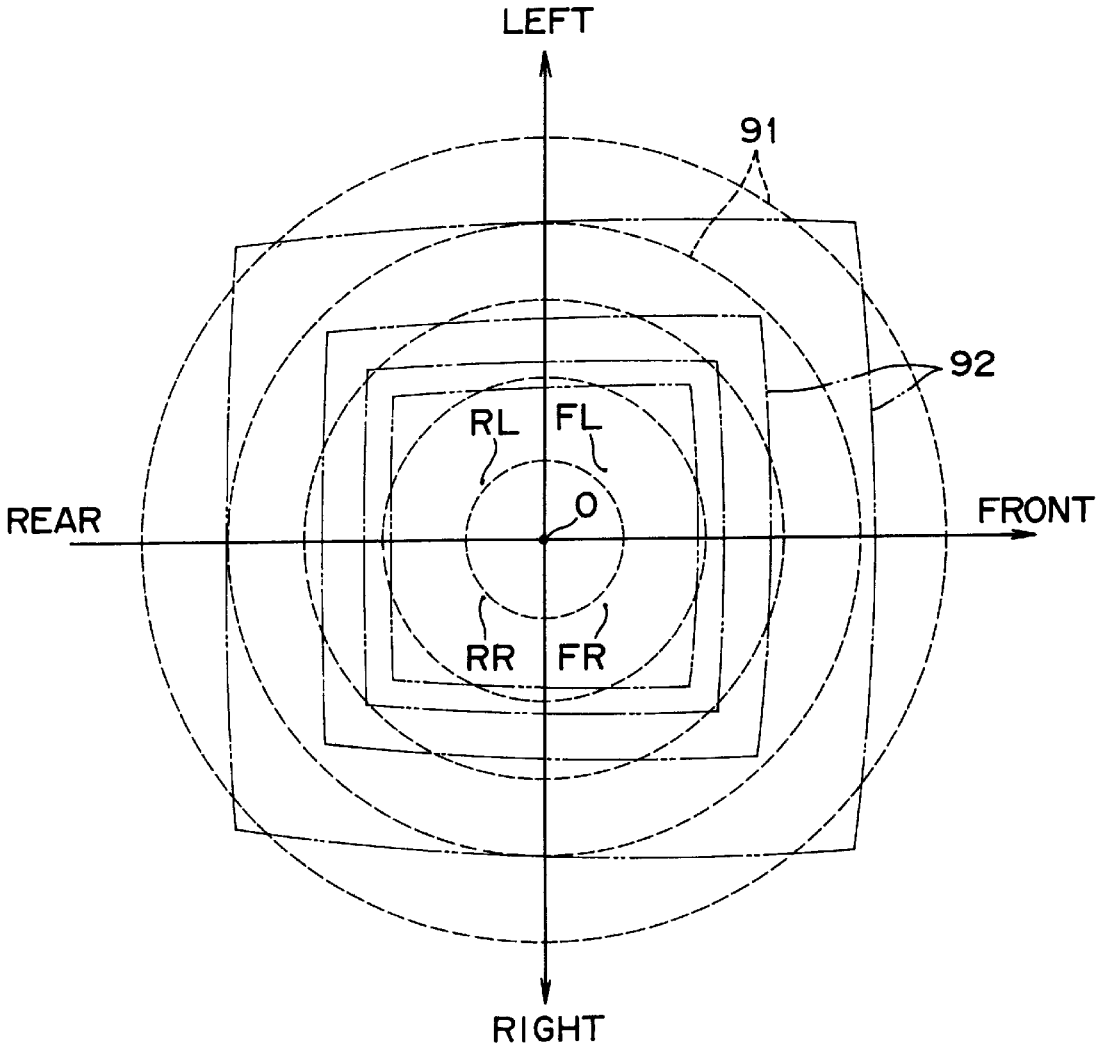
FIG. 13 is a diagram showing general external shapes of strength-based safe work areas and of stability-based safe work areas in the crane.

A display panel 50 shown in FIG. 12*a* is provided with a work condition display section 51, an outrigger jack protruded state display section 52, and a switch section 53. In the work condition display section 51 there are provided not only display portions of boom angle, hoisting load, work radius and limit load (rated load), but also a load factor display portion 54. In the load factor display section 54, as shown in FIG. 12*b*, there are provided load factor display lamps 55 for displaying load factors in plural stages, as well as a discrimination display lamp 56A which is turned ON when the current load factor is based on a strength-based rated load and a discrimination display lamp 56B which is turned ON when the current load factor is based on a stability-based rated load.

According to this configuration, in the load factor display portion 54, not only the current load factor is displayed by the load factor display lamps 55, but also whether the load factor has been calculated from the strength-based rated load or from the stability-based rated load is displayed discriminatively by either the discrimination display lamp 56A or 56B, thus permitting the operator to judge exactly whether attention should now be paid to the strength or to the stability. This is also the case with displaying only the rated load without displaying the load factor.

It is optional whether the above display examples are to be adopted each alone or in combination with other display examples.

While the invention has been described in detail and with reference to specific embodiments thereof, it will be apparent to one skilled in the art that various changes and modifications can be therein without departing from the spirit and scope thereof.

The entire disclosure of the Japanese Patent Application No. 10-205553 filed on Jul. 21, 1998 including specification, claims, drawings and summary are incorporated herein by reference in its entirety.

What is claimed is:

1. A method of setting a safe work area in a swing type work machine for safely operating the work machine in which an article is suspended at a predetermined position of a swing member, characterized by setting, as a safe work area to be used actually, an area where a strength-based safe work area and a stability-based safe work area overlap each other, said strength-based safe work area being established taking the strength of said swing member into consideration and being circular centered on a rotational center of the swing member, said stability-based safe work area being established taking the stability of the work machine into consideration and having a limit work radius which changes depending on the swing angle of the swing member.

2. A method according to claim 1, wherein said stability-based safe work area is an area surrounded with straight lines parallel to tipping lines of the work machine.

3. A swing type work machine with an article suspended at a predetermined position of a swing member, comprising:

a hoisting load detecting means for detecting a hoisting load of said swing member; and an area data output means which outputs an area data of a safe work area to be used actually, said safe work area being an area where a strength-based safe work area and a stability-based safe work area overlap each other, said strength-based safe work area being established taking a hoisting load and the strength of said swing member into consideration and being circular centered on a rotational center of the swing member, said stability-based safe work area being established taking the stability of the work machine into consideration and having a limit work radius which varies depending on a swing angle of the swing member.

4. A swing type work machine according to claim 3, wherein said area data output means outputs an area data so that said stability-based safe work area is surrounded with straight lines parallel to tipping lines of the work machine.

5. A swing type work machine according to claim 3, wherein said area data output means has a memory which stores three-dimensional data using as variables the work radius and swing angle of said swing member and a corresponding rated load, and said area data output means calculates and outputs a corresponding safe work area from the hoisting load detected by said hoisting load detecting means.

6. A swing type work machine according to claim 5, further comprising outrigger jacks protruded in the horizontal direction, and wherein said area data output means has a memory which stores plural kinds of three-dimensional data according to protruded states of said outrigger jacks.

7. A swing type work machine according to claim 3, further comprising:

a work radius detecting means for detecting an actual work radius of said swing member;

a swing angle detecting means for detecting an actual swing angle of said swing member; and a safety control means which makes control to let the work machine perform safe operations on the basis of a comparison of the safe work area outputted from said area data output means with actual work radius and swing angle.

8. A swing type work machine according to claim 7, wherein said safety control means is a swing control means which makes control so that a swing brake is applied at a predetermined timing to stop said swing member within the safe work area.

9. A swing type work machine according to claim 8, wherein said swing control means is provided with a brake angle acceleration calculating means for stopping said swing member without permitting any residual deflection of a suspended article, and makes control so that the rotation of the swing member is braked on the basis of the brake angle acceleration thus calculated.

10. A swing type work machine according to claim 3, further comprising:

a work radius detecting means for detecting an actual work radius of said swing member;

a swing angle detecting means for detecting actual swing angle of said swing member; and a display means which displays on a single display screen the relation of the safe work area outputted from said area data output means to actual work radius and swing angle.

11. A swing type work machine according to claim 10, wherein said display means displays said safe work area three-dimensionally in a cylindrical coordinate system using as variables the work radius and swing angle of said swing member and a corresponding rated load.

12. A swing type work machine according to claim 10, wherein said display means displays a safe work area corresponding to an actual hoisting load on a polar coordinate plane using the work radius and swing angle of said swing member as variables.

13. A swing type work machine according to claim 12, wherein said display means makes a display in such a manner that the larger the actual hoisting load, the larger the scale of the safe work area displayed.

14. A swing type work machine according to claim 10, wherein said display means displays a portion of the safe work area which has been established on the basis of said strength-based safe work area and a portion of the safe work area which has been established on the basis of said stability-based safe work area, in a distinguished manner from each other.

15. A swing type work machine with an article suspended at a predetermined position of a swing member, comprising:

a work radius detecting means for detecting a work radius of said swing member; and a rated load data output means which outputs a rated load selected for each swing angle of said swing member as a rated load to be used actually, said rated load being the lower one out of a strength-based rated load which is established taking said work radius and strength of the swing member into consideration and which is constant independently of the swing angle of the swing member and a stability-based rated load which is established taking the stability of the work machine into consideration and which varies depending on the swing angle of the swing member.

16. A swing type work machine according to claim 15, wherein said rated load data output means has a memory which stores three-dimensional data using as variables the work radius and swing angle of said swing member and a corresponding rated load, and said rate load data output means calculates and outputs a corresponding rated load from the work radius detected by said work radius detecting means.

17. A swing type work machine according to claim 16, further comprising outrigger jacks protruded in the horizontal direction, and wherein said rated load data output means has a memory which stores plural kinds of three-dimensional data according to protruded states of said outrigger jacks.

18. A swing type work machine according to claim 15, further comprising:

a hoisting load detecting means for detecting an actual hoisting load of said swing member;

a swing angle detecting means for detecting an actual swing angle of said swing member; and a safety control means which makes control to let the work machine perform safe operations in accordance with a comparison between the rated load outputted from said rated load data output means and an actual hoisting load.

19. A swing type work machine according to claim 18, wherein said safety control means makes control to restrict the swing speed in accordance with a load factor which is the ratio of the actual hoisting load to the rated load.

20. The swing type work machine according to claim 15, further comprising:

a hoisting load detecting means for detecting an actual hoisting load of said swing member;

a swing angle detecting means for detecting an actual swing angle of said swing member; and a display means which displays the rated load outputted from said rated load data output means.

* * * * *

UNITED STATES PATENT AND TRADEMARK OFFICE

CERTIFICATE OF CORRECTION

PATENT NO. : 6,170,681

DATED : January 9, 2001

INVENTOR(S): Hideaki YOSHIMATSU

It is certified that an error appears in the above-identified patent and that said Letters Patent is hereby corrected as shown below:

On the title page, Item (73), the Assignee's information in incorrect. Item (73) should read as follows:

(73) Assignee: Kabushiki Kaisha Kobe Seiko Sho (Kobe Steel, Ltd.), Kobe (JP)

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,170,681 B1
DATED : January 9, 2001
INVENTOR(S) : Hideaki Yoshimatsu It is certified that error appears in the above-identified patent and that said Letters Patent is hereby corrected as shown below:

Title page,
Item [73], Assignee, should read:
-- [73] Assignee: Kabushiki Kaisha Kobe Seiko Sho (Kobe Steel, Ltd.), Kobe (JP) --

Signed and Sealed this

Twelfth Day of October, 2004

JON W. DUDAS
*Director of the United States Patent and Trademark Office*